US008207912B2

(12) United States Patent
Itokawa et al.

(10) Patent No.: US 8,207,912 B2
(45) Date of Patent: Jun. 26, 2012

(54) DRIVING METHOD FOR PLASMA DISPLAY PANEL AND PLASMA DISPLAY DEVICE

(75) Inventors: Naoki Itokawa, Yokohama (JP); Katsumi Ito, Yokohama (JP); Masaki Kimura, Yokohama (JP); Junichi Kumagai, Yokohama (JP); Yasunobu Hashimoto, Kawasaki (JP); Tomokatsu Kishi, Yokosuka (JP)

(73) Assignee: Hitachi, Ltd., Tokyo (JP)

( * ) Notice: Subject to any disclaimer, the term of this patent is extended or adjusted under 35 U.S.C. 154(b) by 864 days.

(21) Appl. No.: 12/269,721

(22) Filed: Nov. 12, 2008

(65) Prior Publication Data

US 2009/0201226 A1 Aug. 13, 2009

(30) Foreign Application Priority Data

Feb. 8, 2008 (JP) ..... 2008-029378

(51) Int. Cl.
*G09G 3/28* (2006.01)

(52) U.S. Cl. ..... 345/60; 345/62; 345/63; 345/66; 345/67; 345/69

(58) Field of Classification Search ..... 345/60–69, 345/204–213; 315/169.1–169.4; 313/582
See application file for complete search history.

(56) References Cited

U.S. PATENT DOCUMENTS 6,020,687 A * 2/2000 Hirakawa et al. ..... 385/135
6,466,186 B1 10/2002 Shimizu et al.
6,900,781 B1 5/2005 Mori et al.
7,061,479 B2 * 6/2006 Kawasaki et al. ..... 345/204
7,453,423 B2 * 11/2008 Mizobata ..... 345/63
7,605,779 B2 * 10/2009 Chung et al. ..... 345/60
7,924,239 B2 * 4/2011 Yoshihama et al. ..... 345/60
2004/0032553 A1 * 2/2004 Hong ..... 349/113
2004/0257304 A1 12/2004 Yamamoto et al.
2005/0007312 A1 * 1/2005 Tanaka et al. ..... 345/60

(Continued)

FOREIGN PATENT DOCUMENTS

JP 11-282416 10/1999

(Continued)

OTHER PUBLICATIONS

Japanese Office Action issued in Japanese Patent Application No. JP 2008-029378 dated Apr. 13, 2010.

*Primary Examiner* — Prabodh M Dharia
(74) *Attorney, Agent, or Firm* — McDermott Will & Emery LLP

(57) ABSTRACT

Sustain pulses are alternately applied to a pair of display electrodes of discharge cells provided in a plasma display panel (PDP) to generate a sustain discharge to display an image on the PDP. The sustain pulses include two-crests discharge voltage waveforms having a first maximum and second maximum values, in which discharges are generated twice in a half cycle. After applying a sustain pulse having a one-crest discharge voltage waveform to a pair of display electrodes, a predetermined number of sustain pulses of two-crests discharge voltage waveforms are consecutively applied. A time, from applying a second sustain pulse of a two-crests discharge voltage waveform to clamping a voltage of the second sustain pulse to the second maximum value, is made longer than a time, from applying a first sustain pulse of a two-crests discharge voltage waveform to clamping a voltage of the first sustain pulse to the second maximum value.

6 Claims, 5 Drawing Sheets

U.S. PATENT DOCUMENTS

| | | | | |
|---|---|---|---|---|
| 2005/0225511 | A1* | 10/2005 | Kawasaki et al. | 345/60 |
| 2006/0066518 | A1* | 3/2006 | Mizobata | 345/63 |
| 2009/0146922 | A1* | 6/2009 | Yoshihama et al. | 345/60 |

FOREIGN PATENT DOCUMENTS

| | | |
|---|---|---|
| JP | 2000-172223 | 6/2000 |
| JP | 2001-013913 | 1/2001 |
| JP | 2002-6805 | 1/2002 |
| JP | 2002-006806 | 1/2002 |
| JP | 2003-255889 | 9/2003 |
| JP | 2005-010398 | 1/2005 |
| JP | 2006-322976 | 11/2006 |
| JP | 2007-304259 | 11/2007 |
| JP | 2007-3042259 | 11/2007 |
| JP | 2008-058773 | 3/2008 |
| JP | 2008-309826 | 12/2008 |

* cited by examiner

DRIVING METHOD FOR PLASMA DISPLAY PANEL AND PLASMA DISPLAY DEVICE

BACKGROUND OF THE INVENTION

1. Field of the Invention

The present invention relates to a driving method for a plasma display panel and a plasma display device.

2. Description of the Related Art

Up until now, display devices that selectively discharge plural discharge cells to display an image have been known. Examples of the display devices include a plasma display device disclosed in Patent Document 1 that has a display panel including plural discharge cells, a first driving unit that applies a driving pulse to a selected one of the discharge cells of the display panel to generate a first discharge, and a second driving unit that increases, after the voltage of the driving pulse decreases with the generation of the first discharge to weaken at least the first discharge, the voltage of the driving pulse again to generate a second discharge in succession to the first discharge.

In such a plasma display device, only a minimum power required for generating the discharge is input at the time of the first discharge. Therefore, the saturation of ultraviolet rays is alleviated by current limitation from the instant at which the first discharge starts weakening, which results in an improvement in luminous efficiency of the first discharge. As a result, the first discharge having high luminous efficiency as well as the second discharge is performed in all discharge cells to be lit. Accordingly, the luminous efficiency of all the discharge cells to be lit can be improved.

However, Patent Document 1 does not disclose a driving method in which the driving pulses that generate the first and second discharges are consecutively generated.

Meanwhile, according to a general driving method in which a discharge is generated once by one driving pulse to make discharge cells emit light, a high-voltage pulse is applied in a short period of time. Therefore, the discharge generated at this time is strong, which ensures sufficient amounts of wall charges in the discharge cells after the generation of the discharge. Accordingly, after this, it is possible to perform the second discharge described in Patent Document 1. However, according to the driving method described in Patent Document 1 in which the discharges are generated twice by one driving pulse, the strength of the discharges is weakened. As a result, the amount of wall charges in the discharge cells after the generation of the discharge is reduced. Therefore, even if other driving pulses that generate the discharges twice are consecutively applied right after the generation of the initial two discharges, the first discharge at the time of the subsequent two discharges is not properly generated. That is, the subsequent two discharges may not be generated. In other words, it is not possible to consecutively generate the voltage waveforms of the driving pulses having two voltage peaks.

Patent Document 1: JP-A-2002-6805

SUMMARY OF THE INVENTION

Accordingly, the present invention may provide a driving method for a plasma display panel and a plasma display device capable of consecutively generating voltage waveforms that generate sustain discharges twice with the application of one sustain pulse (in a half cycle) to perform the discharges at high efficiency.

In order to achieve the above object, a driving method for a plasma display panel is provided in which sustain pulses are alternately applied to a pair of display electrodes of plural discharge cells provided in the plasma display panel to generate a sustain discharge, thereby causing an image to be displayed on the plasma display panel. The sustain pulses include a two-crests discharge voltage waveform having two maximum values in which discharges are generated twice in a half cycle. The driving method includes consecutively applying the two-crests discharge voltage waveforms to the pair of display electrodes; and making a time until the second one of the maximum values of the subsequently applied two-crests discharge voltage waveform is clamped longer than a time until the second one of the maximum values of the initially applied two-crests discharge voltage waveform is clamped.

Accordingly, it is possible to consecutively generate sustain discharges that generate discharges twice with the application of one sustain pulse, thereby realizing the sustain discharges at high efficiency.

According to embodiments of the present invention, the discharge efficiency of the plasma display panel and the plasma display device can be improved.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENTS

Referring to the accompanying drawings, a description is made of the best mode for carrying out embodiments of the present invention.

Figure 1:
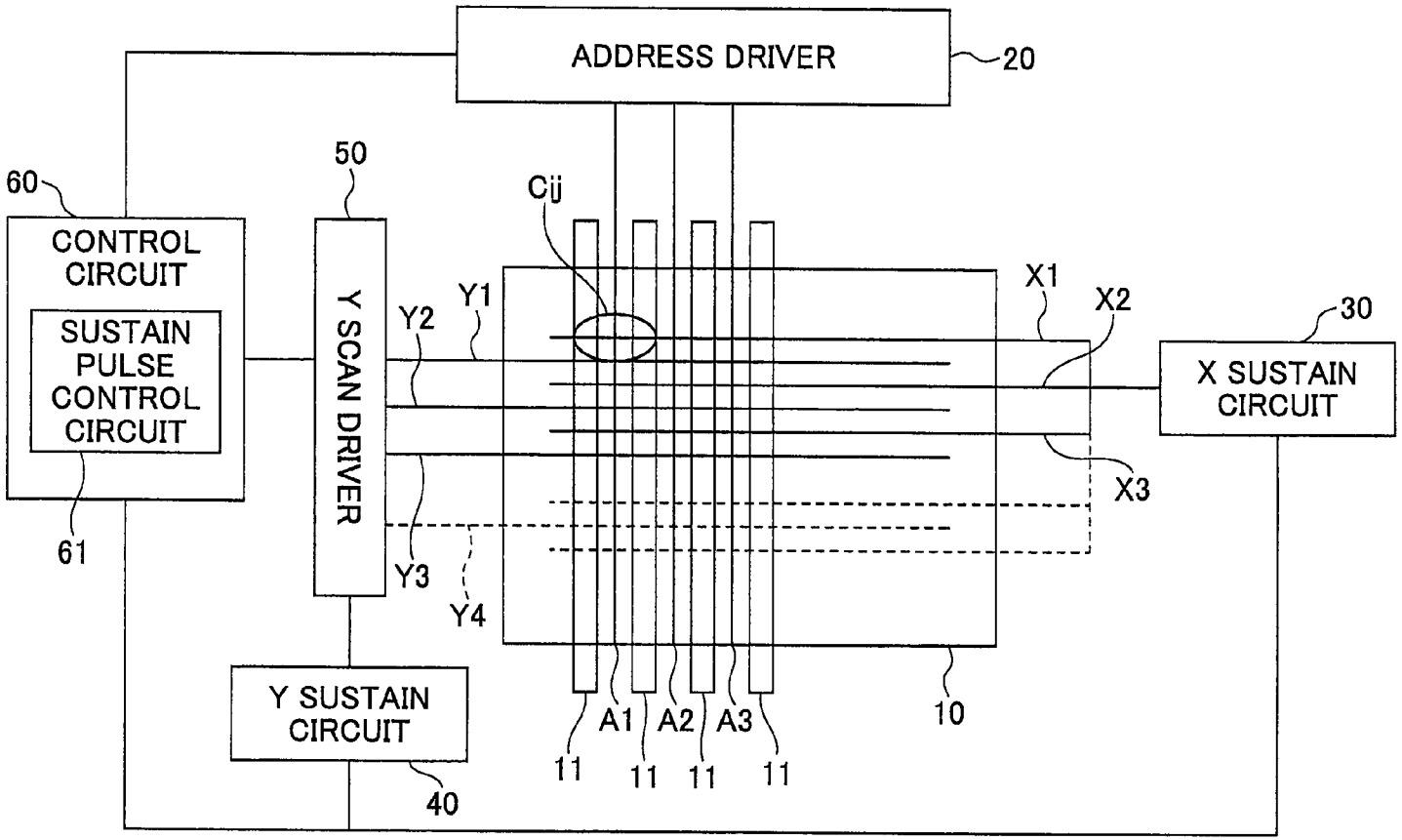
FIG. 1 is a block diagram showing a basic configuration example of a plasma display device according to a first embodiment.

FIG. 1 is a block diagram showing a basic configuration example of a plasma display device according to a first embodiment to which the present invention is applied. The plasma display device according to this embodiment has a plasma display panel 10, an address driver 20, an X sustain circuit 30, a Y sustain circuit 40, a Y scan driver 50, and a control circuit unit 60.

The control circuit unit 60 has a sustain pulse control circuit 61 and controls the address driver 20, the X sustain circuit 30 that drives X-electrodes, the Y sustain circuit 40 that drives Y-electrodes, and the Y scan driver 50.

The address driver 20 supplies a predetermined voltage to address electrodes A1, A2, A3, . . . , etc. In the following description, each of or a generic name of the address electrodes A1, A2, A3, . . . , etc., is referred to as an address electrode "Aj," wherein "j" represents a subscript.

The Y scan driver 50 supplies a predetermined voltage to the Y-electrodes Y1, Y2, Y3, . . . , etc., in accordance with the control by the control circuit unit 60 and the Y sustain circuit 40. In the following description, each of or a generic name of the Y-electrodes Y1, Y2, Y3, . . . , etc., is referred to as a Y-electrode "Yi," wherein "i" represents a subscript.

The X sustain circuit 30 supplies a sustain pulse having the same voltage to X-electrodes X1, X2, X3, . . . , etc., during a sustain discharge period. In the following description, each of or a generic name of the X-electrodes X1, X2, X3, . . . , etc., is referred to as an X-electrode "Xi," wherein "i" represents a subscript. The X-electrodes Xi are mutually connected to one another and have the same voltage level.

The Y sustain circuit 40 applies a sustain pulse having the same voltage to the Y-electrodes Yi through the Y scan driver 50 during a sustain discharge period in the same manner as the X sustain circuit 30.

The X sustain circuit 30 and the Y sustain circuit 40 may have a sustain pulse generation circuit including a power recovery circuit, which is described later.

In the plasma display panel 10, the Y-electrodes Yi and the X-electrodes Xi form rows extending in parallel in a horizontal direction, and the address electrodes Aj form columns extending in a vertical direction. The Y-electrodes Yi and the X-electrodes Xi are alternately arranged in the vertical direction. Ribs 11 have a stripe rib structure, and they are provided between the address electrodes Aj.

The Y-electrode Yi and the address electrode Aj form a two-dimensional matrix constituted of a row (i) and a column (j). A discharge cell "Cij" is formed by an intersection between the Y-electrode Yi and the address electrode Aj and the corresponding X-electrode Xi positioned adjacent to the intersection. This discharge cell Cij corresponds to a pixel. Discharging the discharge cell Cij causes light to emit, which enables the plasma display panel 10 to display a two-dimensional image. Between the X-electrode Xi and the Y-electrode Yi in the discharge cell Cij is provided a space constituting a capacitive load.

When the plasma display panel 10 is driven, its gradation is expressed by sub-fields obtained by dividing a one-field of image into plural pieces. This driving method is called a sub-field method. Each of the sub-fields has a reset period in which wall charges in the discharge cell Cij are initialized, an address period in which an address discharge is generated by the address electrode Aj and the Y-electrode Yi to select the discharge cell Cij that is caused to emit light, and a sustain period in which a sustain pulse is applied to the X-electrode Xi and the Y-electrode Yi of the discharge cell Cij selected during the address period to generate a sustain discharge.

The X-electrode Xi and the Y-electrode Yi constitute a pair of display electrodes. The sustain pulses are alternately applied to the X-electrode Xi and the Y-electrode Yi during the sustain period to generate the sustain discharge, which causes light to emit. As a result, an image is displayed. The X-electrode Xi and the Y-electrode Yi may be called a maintenance electrode and a scan electrode, respectively. The sustain discharges are generated by the number of times corresponding to the weighting orders of gradation display. That is, the sustain discharge is generated every time the sustain pulse is applied to the X-electrode Xi and the Y-electrode Yi. Accordingly, an improvement in discharge efficiency of the sustain discharge leads to an improvement in luminous efficiency of the plasma display panel 10 and the plasma display device.

The sustain pulse control circuit 61 controls the X sustain circuit 30 and the Y sustain circuit 40. Specifically, the sustain pulse control circuit 61 consecutively generates the sustain pulses having two voltage peaks so as to generate the sustain discharges twice with the application of one sustain pulse to the pair of display electrodes Xi and Yi. The driving of the X sustain circuit 30 and the Y sustain circuit 40 is thus controlled. The details of this control are described later.

The control circuit unit 60 may perform control required for driving the plasma display panel 10, in addition to the controlling of the sustain pulses by the sustain pulse control circuit 61. Accordingly, the control circuit unit 60 can display various moving images by properly driving the address driver 20, the X sustain circuit 30, the Y sustain circuit 40, Y scan driver 50, etc., and discharging the discharge cell Cij of the plasma display panel 10. Furthermore, the control circuit unit 60 may have a display load rate detection unit, etc., as occasion demands and have various required functions according to the types and uses of the plasma display panel 10 and the plasma display device.

Figure 2:
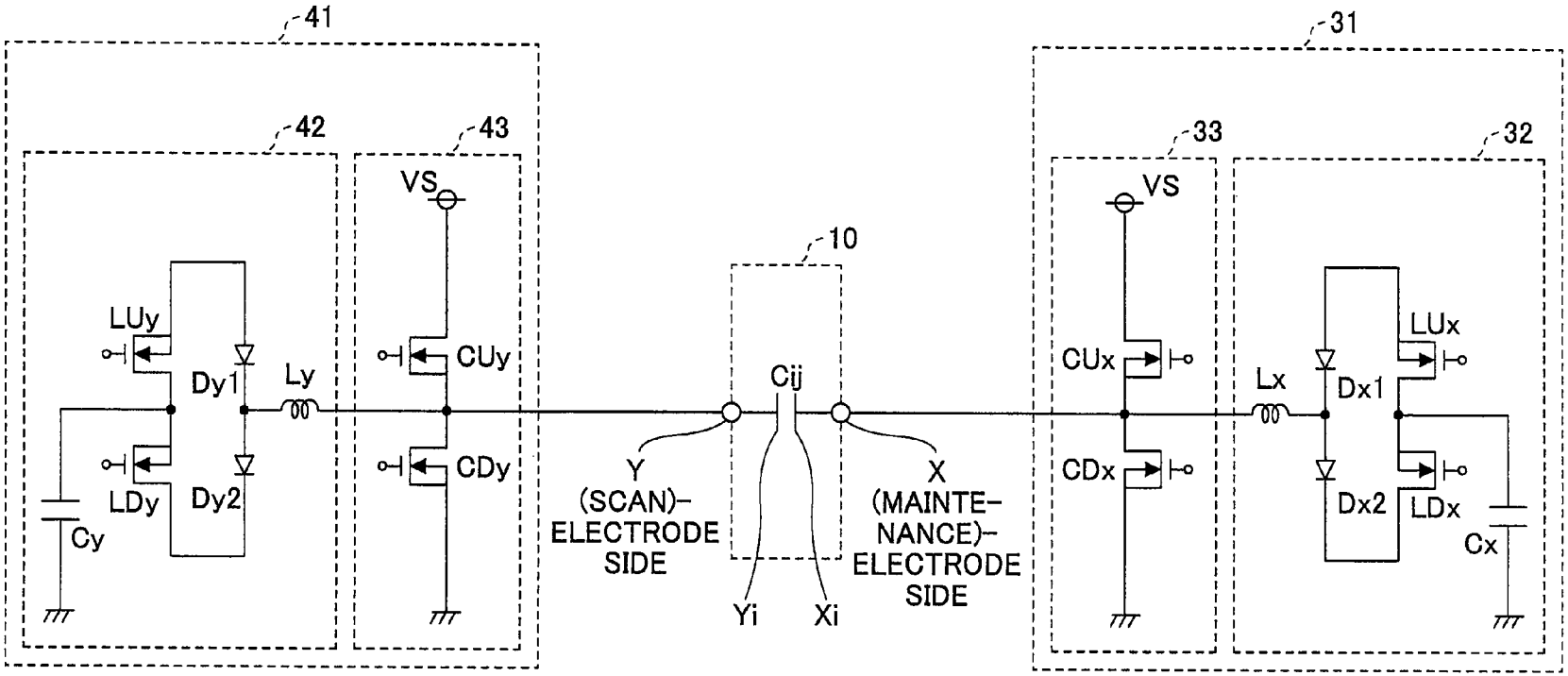
FIG. 2 is a circuit diagram showing the configuration of an X sustain pulse generation circuit 31, a Y sustain pulse generation circuit 41, and a discharge cell Cij.
Figure 3:
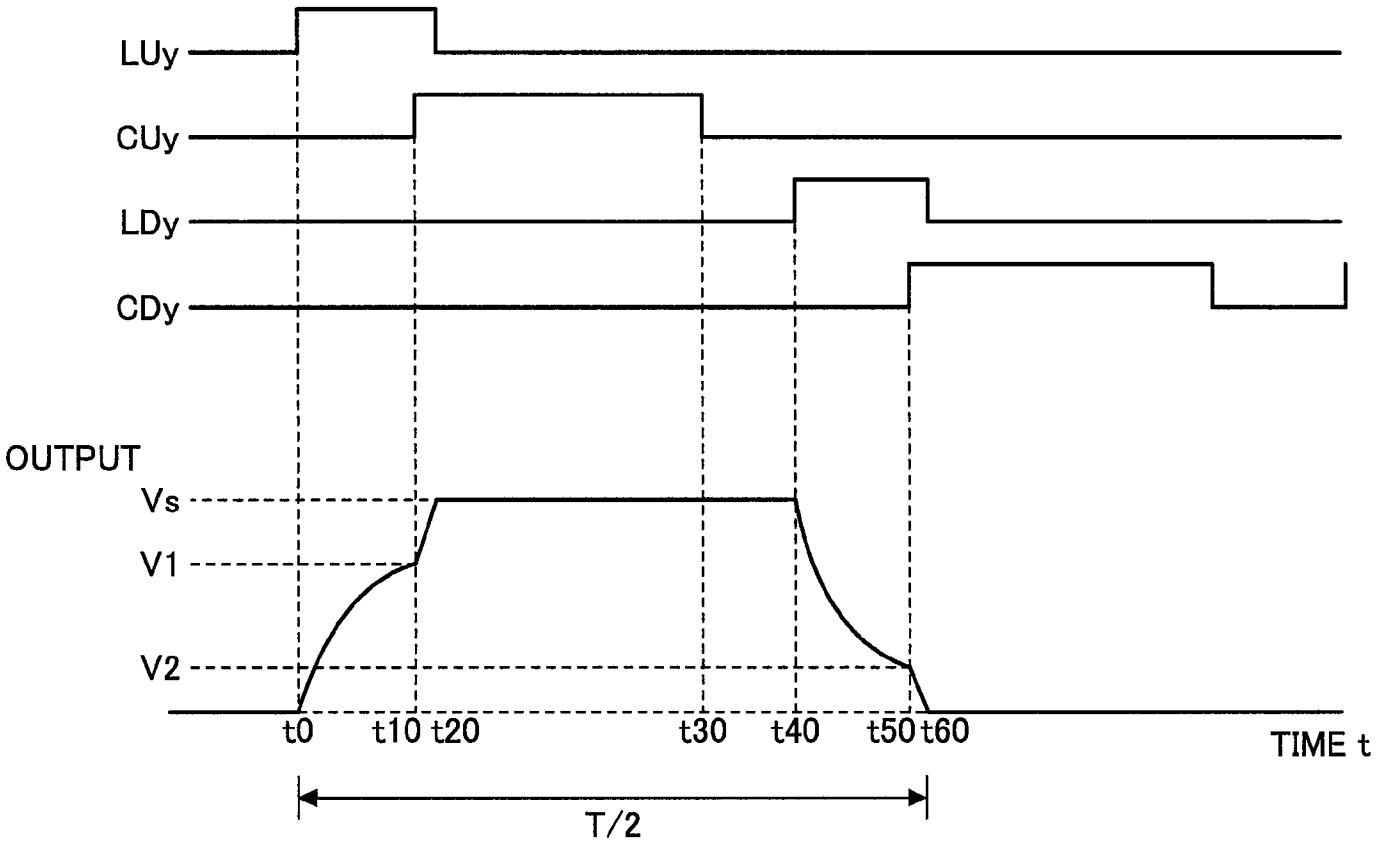
FIG. 3 is a timing chart showing a relationship between the on/off states of switching elements LUy, LDy, CUy, and CDy and the Y sustain pulse applied to the discharge cell Cij.

Next, by referring to FIGS. 2 and 3, a description is made of the configuration and operations of an X sustain pulse generation circuit 31 and a Y sustain pulse generation circuit 41 in the X sustain circuit 30 and the Y sustain circuit 40, respectively.

FIG. 2 is a circuit diagram showing the configuration of the X sustain pulse generation circuit 31 and the Y sustain pulse generation circuit 41 installed in the X sustain circuit 30 and the Y sustain circuit 40, respectively, and the configuration of the discharge cell Cij in the plasma display panel 10. In FIG. 2, a circuit that generates a scan pulse and an initialization voltage waveform is omitted.

The Y sustain pulse generation circuit 41 has a power recovery circuit 42 and a clamp circuit 43. The power recovery circuit 42 has a capacitor Cy for power recovery, switching elements LUy and LDy, diodes Dy1 and Dy2 for backflow prevention, and a coil Ly for resonance. Furthermore, the clamp circuit 43 has a switching element CUy for clamping the Y-electrode Yi to a power supply VS having a voltage of Vs and a switching element CDy for clamping the Y-electrode Yi to ground. The power recovery circuit 42 and the clamp circuit 43 are connected to the Y-electrode Yi of the discharge cell Cij constituting the capacitive load of the plasma display panel 10 through the Y scan driver 50 (Y scan driver 50 is not shown in FIG. 2 because it is short-circuited during the sustain period).

The power recovery circuit 42 causes the discharge cell Cij as the capacitive load and the coil Ly to form LC resonance to cause the rise and fall the sustain pulse. At the time of causing the sustain pulse to rise, the power recovery unit 42 moves charges accumulated in the capacitor Cy for power recovery to the discharge cell Cij through the switching element LUy, the diode Dy1, and the coil Ly. At the time of causing a maintenance pulse to fall, the power recovery unit 42 returns the charges accumulated in the discharge cell Cij to the capacitor Cy for power recovery through the coil Ly, the diode Dy2, and the switching element LDy. Thus, the sustain pulse is applied to the Y-electrode Yi. Because the power recovery circuit 42 drives the Y-electrode Yi using the LC resonance, it consumes less power. Note that the capacitor Cy for power recovery has a sufficiently large capacity as compared with the discharge cell Cij of the capacitive load and is charged to a voltage of about Vs/2, half a voltage Vs of the power supply VS so as to serve as the power supply of the power recovery circuit 42.

The clamp circuit 43 connects the Y-electrode Yi to the power supply VS through the switching element CUy and clamps the Y-electrode Yi to the voltage Vs. Furthermore, the clamp circuit 43 connects the Y-electrode Yi to ground through the switching element CDy and clamps it to a voltage of 0 (V). Thus, the clamp circuit 43 drives the Y-electrode Yi. Accordingly, an impedance generated when the clamp circuit 43 applies a voltage is small, which in turn can allow a stable flow of a large discharge current using a strong sustain discharge.

Thus, the Y sustain pulse generation circuit 41 applies the sustain pulse to the Y-electrode Yi using the power recovery circuit 42 and the clamp circuit 43 by controlling the switching elements LUy, LDy, CUy, and CDy. Note that the switching elements LUy, LDy, CUy, and CDy can be composed of known semiconductor elements such as MOSFET and IGBT.

The X sustain pulse generation circuit 31 has a power recovery circuit 32 and a clamp circuit 33. The power recovery circuit 32 has a capacitor Cx for power recovery, switching elements LUx and LDx, diodes Dx1 and Dx2 for backflow prevention, and an inductor Lx for resonance. The clamp circuit 33 has a switching element CUx for clamping the X electrode Xi to the voltage Vs and a switching element CDx for clamping the X-electrode Xi to ground. The X sustain pulse generation circuit 31 is connected to the X-electrode Xi of the discharge cell Cij constituting the capacitive load of the plasma display panel 10. Note that because the operations of the X sustain pulse generation circuit 31 are the same as those of the Y sustain pulse generation circuit 41, their descriptions are omitted.

Next, by referring to FIGS. 2 and 3, a description is made of an example of a voltage waveform of the sustain pulse generated from the X sustain pulse generation circuit 31 and the Y sustain pulse generation circuit 41. FIG. 3 is a timing chart showing a relationship between the on/off states of the switching elements LUy, LDy, CUy, and CDy of the Y sustain pulse generation circuit 41 and an output voltage waveform of a Y sustain pulse applied to the discharge cell Cij as the capacitive load.

FIG. 3 shows the output voltage waveform during T/2, half a cycle of one sustain pulse, i.e., the Y sustain pulse and the timing of on/off of the switching elements LUy, LDy, CUy, and CDy. In FIG. 3, a horizontal axis represents time t(s), and a vertical axis represents a voltage V (V).

In FIG. 3, the switching element LUy is turned on when t=t0, and the charges accumulated in the capacitor Cy for power recovery are moved to the discharge cell Cij through the switching element LUy, the diode Dy1, and the coil Ly to flow a current. At this time, due to the LC resonance formed by the coil Ly and the discharge cell Cij, an output voltage gradually rises from t=t0 to t=t10 in a curve.

Next, the switching element CUy is turned on when t=t10. Accordingly, the output voltage is clamped to the power supply voltage Vs. The output voltage V is V1 (V=V1) when t=t10, but it rapidly rises up to the power supply voltage Vs in a straight line.

The switching element LUy is turned off when t=t20, and the output voltage V becomes Vs (V=Vs) having the same potential as the power supply voltage Vs and reaches the voltage peak value Vs.

Then, the on-state of the switching element CUy is continued until t=t30, and the output voltage V is maintained at the voltage peak Vs (V=Vs). Furthermore, although the switching element CUy is turned off when t=t30, the output voltage V is maintained at Vs (V=Vs) because the sufficient charges are accumulated in the discharge cell Cij constituting the capacitive load.

During a period from t=t20 to t=t30 or t=t40 to be described next, the sustain discharge is generated between the pair of display electrodes Xi and Yi of the discharge cell Cii.

The switching element LDy is turned on when t=t40. The charges accumulated in the discharge cell Cij are moved to the capacitor Cy for power recovery through the coil Ly, the diode Dy2, and the switching element LDy to flow a current. At this time, due to the LC resonance formed by the discharge cell Cij and the coil Ly, the output voltage V of the sustain pulse gradually falls. Then, the power is recovered by the capacitor Cy.

When the output voltage V falls from the voltage peak Vs to V2 due to the LC resonance, the switching element CDy is turned on when t=t50, and the output voltage V is clamped to 0 of ground (V=0). Then, the output voltage rapidly falls.

The switching element LDy is turned off when t=t60, and the output voltage V is completely clamped to 0 (V) (V=0). Then, the on-state of the switching element CDy is continued for a while, and the output voltage V is maintained at 0 (V=0).

After that, in the X sustain pulse generation circuit 31*a*, the sustain pulse is generated in accordance with a timing chart similar to FIG. 3 and applied to the pair of display electrodes Xi and Yi to generate the sustain discharge having a reverse polarity. During this period, the Y sustain pulse is not applied while the state of V=0 is maintained. When the application of an X sustain pulse is completed, the next Y sustain pulse is to be applied in turn. As for the operations of the X sustain pulse generation circuit 31, the description of FIG. 3 can be applied as it is if the switching elements LUy, LDy, CUy, and CDy are replaced by the switching elements LUx, LDx, CUx, and CDx, the capacitor Cy for power recovery is replaced by the capacitor Cx, and the diodes Dy1 and Dy2 for backflow prevention are replaced by the diodes Dx1 and Dx2. Therefore their descriptions are omitted here.

Figure 4:
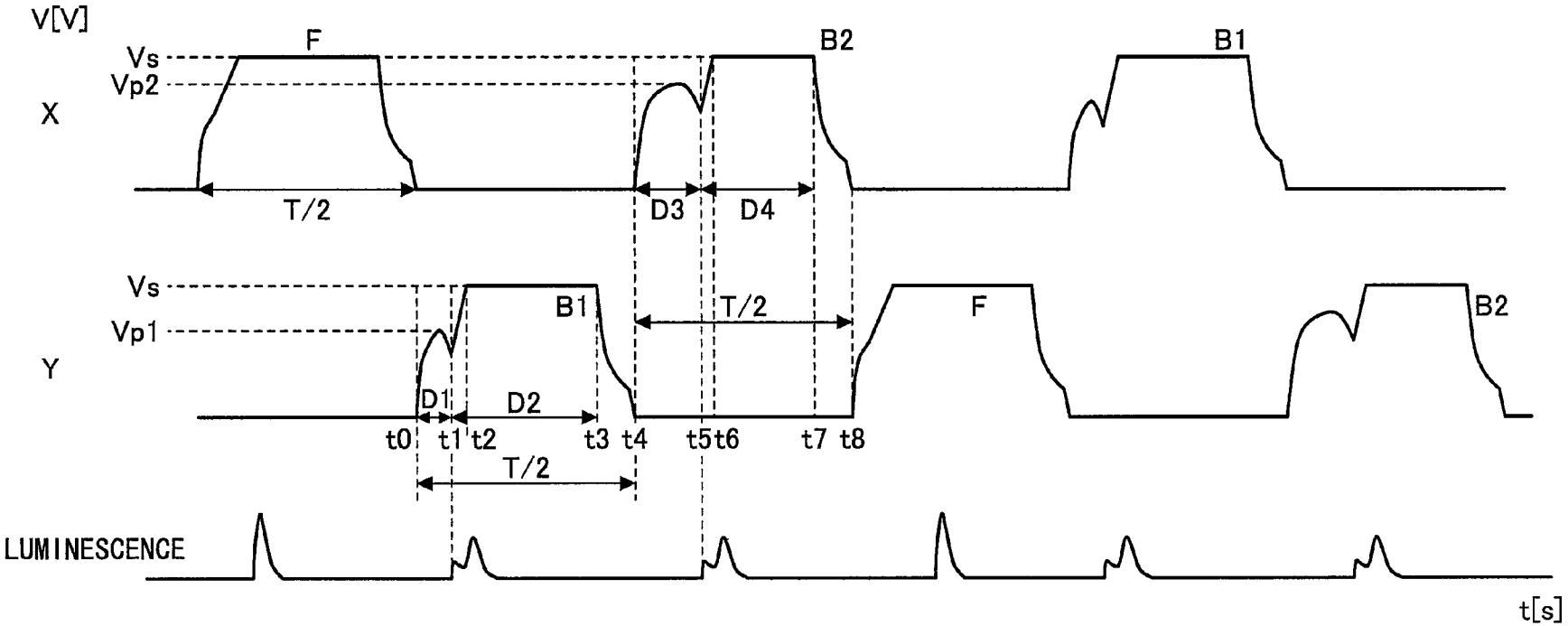
FIG. 4 is a waveform chart showing sustain pulses having two maximum values in a half cycle according to a first embodiment.

The timing of the on/off of the switching elements LUx, LDx, CUx, CDx, LUy, LDy, CUy, and CDy of the sustain pulse generation circuits 31 and 41 is controlled as described above, thereby making it possible to control the voltage waveform of the sustain pulse. The timing of the switching elements LUx, LDx, CUx, CDx, LUy, LDy, CUy, and CDy can be controlled by the sustain pulse control circuit 61 described in FIG. 1. In FIG. 3, a description is made of an example in which the voltage waveform having the one voltage peak is generated by the application of the one sustain pulse. However, in a driving method for the plasma display panel 10 according to this embodiment, one sustain pulse that generates two maximum values to generate the discharges twice is consecutively applied. Referring to FIG. 4, a description of this is made below.

FIG. 4 is a waveform chart showing sustain pulses having two voltage maximum values in a half cycle, which are generated by the driving method for the plasma display panel 10 according to the first embodiment.

FIG. 4 shows the X sustain pulse, the Y sustain pulse, and the voltage waveform in a luminescent state, defining a horizontal axis as time t(s) and a vertical axis as voltage V (V). In both of the X sustain pulse and the Y sustain pulse, the voltage waveform of a normal sustain pulse having one voltage peak is called a "one-crest discharge voltage waveform F," the voltage waveform of a sustain pulse having two voltage maximum values generated right after the one-crest discharge voltage waveform F is called a "first two-crests discharge voltage waveform B1," and the voltage waveform of a sustain pulse having two voltage maximum values generated right after the first two-crests discharge voltage waveform B1 is called a "second two-crests discharge voltage waveform B2."

In FIG. 4, the first sustain pulse of the X sustain pulse is the one-crest discharge voltage waveform F similar to the voltage waveform shown in FIG. 3. That is, it is the voltage waveform having the one-crest voltage peak in which the clamp timing after the start of the LC resonance is quick (timing of t=t10 is quick in FIG. 3) at the time of causing the sustain pulse to rise, the output voltage then reaches the voltage peak Vs substantially linearly, the voltage peak Vs is maintained as it is, and after that the voltage falls in the latter half of the half cycle. In this case, only one strong discharge is generated in the pair of display electrodes Xi and Yi of the discharge cell Cij.

On the other hand, the voltage waveform of the next Y sustain pulse indicates the first two-crests discharge voltage waveform B1 in which the first maximum value V=Vp1 is provided during a period D1 and the second maximum value V=Vs is provided during a period D2. This voltage waveform is formed in the following manner. Specifically, the clamp timing t=t1 is delayed in the LC resonance at the time of causing the sustain pulse to rise. During the LC resonance, the first weak sustain discharge is generated, while the clamping is performed at the timing at which the voltage of the sustain pulse in the first discharge falls. At this time, the power supply voltage Vs is supplied so that the voltage waveform reaches the second maximum value Vs when t=t2. In the second voltage maximum value Vs, the second sustain discharge stronger than the first sustain discharge is generated. Therefore, the first two-crests discharge voltage waveform B1 is a voltage waveform that generates the sustain discharges twice in the half cycle T/2. Accordingly, because the discharges are generated in the two crests, the sustain discharges can be performed at high efficiency.

Here, the one-crest discharge voltage waveform F and the first two-crests discharge voltage waveform B1 are compared with each other. As for the strength of the discharge, the one-crest discharge voltage waveform F that generates the strong discharge in a short period of time is stronger than the first two-crests discharge voltage waveform B1. As for luminous efficiency, however, the first two-crests discharge voltage waveform B1 that consecutively generates the weak discharges is higher than the one-crest discharge voltage waveform F. As control required for generating the first two-crests discharge voltage waveform B1, the clamp timing t=t1 is delayed longer than the case of the one-crest discharge voltage waveform F (t=t10 in FIG. 3), the clamping is not performed until the weak discharge is generated due to the LC resonance at the time of causing the sustain pulse to rise: the clamping is performed at the timing at which the discharge is generated. Such control can be realized by adjusting the clamp timing in the sustain pulse control circuit 61.

Next, the second two-crests discharge voltage waveform B2 is described. After the first two-crests discharge is performed using the first two-crests discharge voltage waveform B1, the amount of the wall charges in the discharge cell Cij is reduced more than the amount of the wall charges in the discharge cell Cij when the one-crest discharge is performed using the one-crest discharge voltage waveform F. Accordingly, even if the sustain pulse having the same voltage waveform as the first two-crests discharge voltage waveform B1 is consecutively applied, the two-crests discharge is not generated.

Therefore, in the driving method for the plasma display panel 10 according to this embodiment, when the second two-crests discharge voltage waveform B2 is consecutively applied to generate the two-crests discharge right after the application of the first two-crests discharge voltage waveform B1, the clamp timing t=t5 of the second two-crests discharge voltage waveform B2 is delayed further longer than the clamp timing t=t2 of the first two-crests discharge voltage waveform B1. Then, the clamping is not performed until the first discharge is generated in the rising voltage waveform due to the LC resonance: the clamping is performed at the timing at which the voltage of the sustain pulse falls when t=t5 after the generation of the first discharge. Accordingly, even if the amount of the wall charges in the discharge cell Cij is smaller than the amount of the wall charges in the discharge cell Cij when the one-crest discharge is performed using the one-crest discharge voltage waveform F, which results in a difficulty in generating the discharge, the clamp timing of the second two-crests discharge voltage waveform B2 is delayed further longer than the clamp timing of the first two-crests discharge voltage waveform B1, and D3 is set to be greater than D1 (D1<D3). Accordingly, it is possible to generate the two-crests discharge using the second two-crests discharge voltage waveform B2 and realize the sustain discharge at high efficiency. The two-crests discharge has high luminescent efficiency as described above. Therefore, the frequency of the two-crests discharge in one sub-field is increased, thereby making it possible to reliably improve the discharge efficiency of the sustain discharge.

Note that the timing for causing the sustain pulse to fall due to the LC resonance (t=3 and t=7) and the timing for clamping the output voltage to 0 (V=0) may be the same in any of the one-crest discharge voltage waveform F, the first two-crests discharge voltage waveform B1, and the second two-crests discharge voltage waveform B2.

Furthermore, the length of the half cycle T/2 of the sustain pulse may be the same in any of the one-crest discharge voltage waveform F, the first two-crests discharge voltage waveform B1, and the second two-crests discharge voltage waveform B2.

The control for properly setting the clamp timing described above may be performed by the sustain pulse control circuit 61. For example, the X sustain pulse generation circuit 31 and the Y sustain pulse generation circuit 41 may be controlled based on predetermined clamp timing set in each of the one-crest discharge voltage waveform F, the first two-crests discharge voltage waveform B1, and the second two-crests discharge voltage waveform B2 according to the types and uses of the plasma display panel 10 and the plasma display device.

Note that FIG. 4 shows an example in which the sustain pulses of the one-crest discharge voltage waveform F are applied before the first two-crests discharge voltage waveform B1 and after the second two-crests discharge voltage waveform B2. The one-crest discharge voltage waveform F can generate a strong discharge to arrange the amount of the wall charges in the discharge cell Cij. Therefore, it is preferable that the sustain pulse of the one-crest discharge voltage waveform be applied before or after the consecutive two-crests discharge voltage waveforms B1 and B2 at appropriate timing.

Furthermore, in FIG. 4, the two-crests discharge voltage waveforms B1 and B2 are consecutively applied twice, but they may consecutively be applied three times or more. In this case, the clamp timing at the time of the rising in the subsequent two-crests discharge voltage waveform is set to be necessarily delayed longer than the clamp timing at the time of the rising in the prior two-crests discharge voltage waveform. In other words, a time until the output voltage is clamped to the second voltage maximum value Vs in the subsequent two-crests discharge voltage waveform is set to be longer than a time until the output voltage is clamped to the second voltage maximum value Vs in the prior two-crests discharge voltage waveform.

As described above, the time required for reaching the second voltage maximum value in the subsequent two-crests discharge voltage waveform is set to be longer than the time required for reaching the second voltage maximum value in the prior two-crests discharge voltage waveform. Thus, the discharge efficiency of the sustain discharge can be improved.

Second Embodiment

Figure 5:
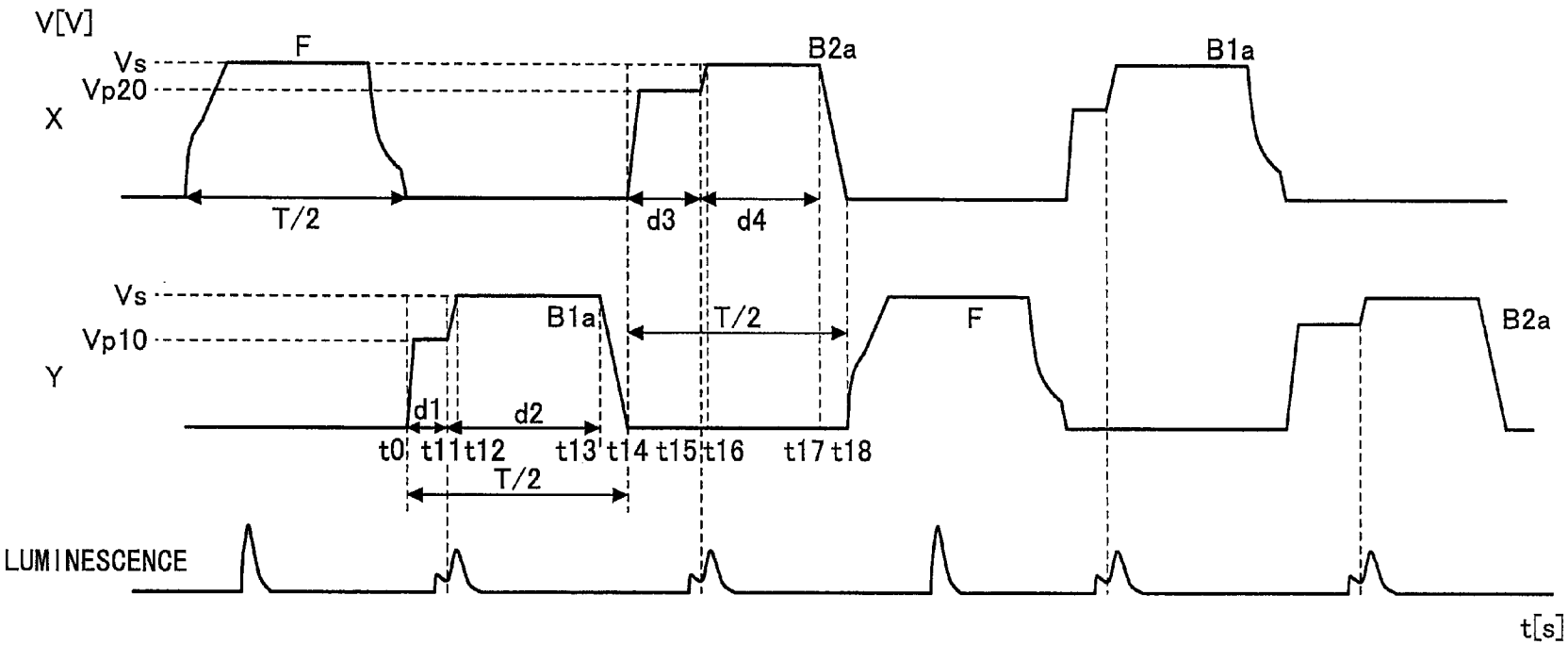
FIG. 5 is a waveform chart showing a driving method for a plasma display panel 10 and a plasma display device according to a second embodiment.

FIG. 5 is a waveform chart showing a driving method for the plasma display panel 10 and the plasma display device according to a second embodiment to which the present invention is applied. Similar to the case of FIG. 4, FIG. 5 shows the X sustain pulse, the Y sustain pulse, and the voltage waveform of a luminescent voltage, defining a horizontal axis as time t(s).

FIG. 5 is similar to FIG. 4 of the first embodiment in that the one-crest discharge voltage waveform F having one voltage peak Vs as the X sustain pulse is first applied, a first two-crests discharge voltage waveform B1*a* having two voltage maximum values is then applied as the Y sustain pulse, and after that a second two-crests discharge voltage waveform B2*a* is consecutively applied to the pair of display electrodes Xi and Yi as the X sustain pulse.

On the other hand, FIG. 5 is different from FIG. 4 in that the voltage waveform at the time of the rising in the first two-crests discharge voltage waveform B1*a* and the second two-crests discharge voltage waveform B2 depends not on the LC resonance but on the clamping. Thus, the consecutive two-crests discharge voltage waveforms B1*a* and B2*a* may depend on a discharge in two stages in which all the voltage maximum values are realized by the clamping rather than the LC resonance. In this case also, when the two-crests discharges are consecutively applied, the amount of the wall charges in the discharge cell Cij is insufficient in the subsequent two-crests discharge, which results in a difficulty in generating the first sustain discharge. Therefore, the clamp timing t=t15 in the second two-crests discharge voltage waveform B2*a* is set to be delayed longer than the clamp timing t=t11 in the first two-crests discharge voltage waveform B1*a*. In other words, time d3 until the output voltage is clamped to the second maximum value Vp20 (V=Vp20) in the second two-crests discharge voltage waveform B2*a* is set to be longer than time d1 until the output voltage is clamped to the second maximum value Vp10 (V=Vp10) in the first two-crests discharge voltage waveform B1*a*.

Accordingly, even if the two-crests discharge voltage waveforms B1*a* and B2*a* that generate the discharge in two stages due only to the clamping are consecutively applied, the discharges can reliably be generated twice even in the subsequent two-crests discharge voltage waveform B2*a*. As a result, the sustain discharge can be performed at high efficiency.

Note that similar to the case of the first embodiment, the length of the half cycle T/2 for all the sustain pulses may be the same. Furthermore, the sustain pulse of the one-crest discharge voltage waveform F is supplied to arrange the amount of the wall charges at appropriate timing before and after the consecutive two-crests discharge voltage waveforms B1*a* and B2*a*. Furthermore, the two-crests discharge voltage waveforms may consecutively be applied three times or more.

Note that in the case of the second embodiment, the X sustain pulse generation circuit 31 and the Y sustain pulse generation circuit 41 do not require the power recovery circuits 32 and 42, and they can be configured as simplified circuits having the switching elements, etc., for the clamping. Furthermore, the settings and control of clamp time by the sustain pulse control circuit 61 can be performed in the same manner as the first embodiment.

According to the discharge in two stages of the second embodiment, it is possible to consecutively perform the sustain discharge that reliably generates the discharges twice using the one sustain pulse under secured potential fixing control.

The present invention is not limited to these embodiments, but various variations and modifications may be made without departing from the scope of the present invention.

The present application is based on Japanese Priority Application No. 2008-029378 filed on Feb. 8, 2008, with the Japan Patent Office, the entire contents of which are hereby incorporated herein by reference.

What is claimed is:

1. A driving method for a plasma display panel in which sustain pulses are alternately applied to a pair of display electrodes of plural discharge cells provided in the plasma display panel to generate a sustain discharge, thereby causing an image to be displayed on the plasma display panel, wherein the sustain pulses include a one-crest discharge voltage waveform having one voltage peak that generates a discharge once by applying one pulse and a two-crests discharge voltage waveform having a first maximum value and a second maximum value that generates discharges twice by applying one pulse, the second maximum value being clamped to a predetermined voltage smaller than the first maximum value, the driving method comprising:

consecutively applying a predetermined number of the sustain pulses of two-crests discharge voltage waveforms, after applying the sustain pulse of one-crest discharge waveform to the pair of display electrodes, the sustain pulse of one-crest discharge waveform being applied to the pair of display electrodes for every predetermined number of applications of the sustain pulses of two-crests discharge voltage waveform to the pair of display electrodes; and making a second time period, which is from a start of applying a second sustain pulse of two-crests discharge voltage waveform until a voltage of the second sustain pulse is clamped to the second maximum value, longer than a first time period, from a start of applying a first sustain pulse of two-crests discharge voltage waveform until a voltage of the first sustain pulse is clamped to the second maximum value in any two consecutive sustain pulses of two-crests discharge voltage waveform.

2. The driving method for a plasma display panel according to claim 1, wherein a voltage waveform including the first maximum value of the sustain pulse of two-crests discharge voltage waveform is a voltage waveform caused by LC resonance.

3. The driving method for a plasma display panel according to claim 1, wherein the sustain pulse of one-crest discharge voltage waveform and the sustain pulses of two-crests discharge voltage waveform have the same application period.

4. A plasma display device comprising:

a plasma display panel provided with plural discharge cells having a pair of display electrodes;

a sustain circuit that alternately applies sustain pulses to the pair of display electrodes to generate a sustain discharge in the discharge cells; and a sustain pulse control circuit that controls the sustain pulses applied by the sustain circuit; wherein:

the sustain pulse control circuit consecutively generates a predetermined number of the sustain pulses of two-crests discharge voltage waveform having a first maximum value and a second maximum value, after generating a sustain pulse of one-crest discharge waveform, wherein the sustain pulse of one-crest discharge waveform is generated for the predetermined number of the sustain pulses of two-crests discharge waveform for application to the pair of display electrodes, and makes a second time period, which is from a start of applying a second sustain pulse of two-crests discharge voltage waveform until the second sustain pulse is clamped to the second maximum value, longer than a first time period, which is from a start of applying a first sustain pulse of two-crests discharge voltage waveform until a voltage of the first sustain pulse is clamped to the second maximum value, in any two consecutive sustain pulses of two-crests discharge voltage waveform.

5. The plasma display device according to claim 4, wherein:

the sustain circuit includes a power recovery circuit having a coil, and a voltage waveform having the first maximum value of the sustain pulse of two-crests discharge voltage waveform is generated by LC resonance due to the discharge cells and the coil.

6. The plasma display device according to claim 5, wherein the sustain pulse control circuit generates both sustain pulses of one-crest discharge voltage waveform and two-crests discharge voltage waveform having the same application period.

* * * * *